United States Patent [19]

Smith et al.

[11] 4,312,278

[45] Jan. 26, 1982

[54] CHIP WOOD FURNACE AND FURNACE RETROFITTING SYSTEM

[75] Inventors: Norman Smith; John G. Riley, both of Orono; Edward R. Huff, Old Town; Dwight C. Worcester, Winterport, all of Me.

[73] Assignee: Board of Trustees of the University of Maine, Bangor, Me.

[21] Appl. No.: 171,138

[22] Filed: Jul. 22, 1980

[51] Int. Cl.[3] ..... F23B 7/00

[52] U.S. Cl. ..... 110/234; 110/102; 110/186; 110/187; 110/260; 126/111

[58] Field of Search ..... 110/102, 233, 234, 260, 110/186, 187; 126/110 R, 110 B, 111, 222, 225

[56] References Cited

U.S. PATENT DOCUMENTS

| | | | |
|---|---|---|---|
| 2,228,751 | 1/1941 | Bros | 110/102 |
| 4,027,602 | 6/1977 | Mott | 110/234 X |
| 4,078,541 | 3/1978 | Roycraft | 110/260 X |
| 4,130,105 | 12/1978 | Melton | 126/111 X |
| 4,162,686 | 6/1979 | Infield et al. | 110/260 X |
| 4,222,364 | 9/1980 | Wright | 126/111 |
| 4,263,887 | 4/1981 | Dowdan | 126/110 R |

*Primary Examiner*—Edward G. Favors
*Attorney, Agent, or Firm*—Daniel H. Kane, Jr.

[57] ABSTRACT

A furnace system suitable for independent use and for retrofitting conventional central heating oil furnaces to permit controlled continuous and efficient combustion of fragmented wood type fuels. Wood chips or other fuel fragments are trickle fed into a refractory wood type combustion chamber. For retrofitting an oil furnace the oil burner gun is removed. A flame tube adapter couples the wood type fuel combustion chamber into the oil combustion chamber and heat exchanger plenum of the conventional furnace. The oil burner gun of the retrofitted furnace is used to ignite the wood chips or other fuel fragments during start up. A blower establishes forced draft. The furnace system includes automatic controls for sequencing operation of the elements of the retrofitting furnace system. An independent wood chip furnace system is also described.

27 Claims, 9 Drawing Figures

CHIP WOOD FURNACE AND FURNACE RETROFITTING SYSTEM

FIELD OF THE INVENTION

This invention relates to a new and improved furnace system suitable for independent use and for retrofitting conventional central heating oil furnaces to permit controlled, continuous, and efficient combustion of fragmented wood type fuels such as chipped, hogged, and pellitized wood, bark, wood waste, and logging residues.

BACKGROUND OF THE INVENTION

The rising cost of imported petroleum fuels has intensified the search for more efficient and convenient systems for obtaining heat from wood. The more traditional approach to burning wood fuel as logs or sticks whether in space heating wood stoves or more sophisticated central heating wood fuel furnaces suffer the disadvantage that they are non-automatic and require periodic hand loading of the log wood fuel. While large scale automated log fuel burners have been in existance for many years, there are at present no suitable systems available for residential and small scale use with heat outputs in the range, for example of 50,000 to 100,000 BTU/hr.

Wood chips offer an alternative form of wood fuel more suitable for automatic feed furnaces than the more traditional log wood fuel. This fragmented form of wood fuel may be derived from a number of sources including whole trees, brush, industrial waste wood, and the tops and branches left in the woods after logging operations. Under present harvesting methods it is estimated that one third of the weight of harvested trees is left in the forest, mainly as cull logs, tops and branches. If all these logging residues could be efficiently used, they would supply a substantial portion of residential heating needs in regions with abundant timber resources. The advantage of using this resource in fragmented or chipped form is that it allows reduction of all types of wood to a useable form.

By chipping or pellitizing the wood resource into a fragmented form of substantially uniform range of fragment size, continuous feed of wood fuel at a rate commensurate with residential and small scale heating applications is possible. The physical characteristics of wood chips and pellitized wood material combined with the slow steady feed requirements and scaling factors demand a furnace system of unique design. Furthermore because of the nearly ubiquitous distribution of conventional oil furnaces throughout the northern climates it would be advantageous to incorporate or retrofit such oil furnaces into the wood type fuel fired central heating furnace system.

OBJECTS OF THE INVENTION

It is therefore an object of the present invention to provide a new and improved residential or small scale retrofitting furnace system for automatically controlled continuous and efficient combustion of fragmented wood type fuels such as chipped, hogged, and pelletized wood, bark, wood waste and logging residues. A feature and advantage of the retrofitting system is that it is adapted for utilizing and retrofitting conventional oil fired hot air and hot water furnace systems of the kind having an oil combustion chamber, heat exchanger, and oil burner gun motor and firing means.

Another object of the invention is to provide a substitute for the oil burner gun motor and firing means in the form of a wood type fuel "gun" for retrofitting and firing conventional oil furnaces. According to the invention the conventional oil gun is removed one stage from the furnace and fitted to the wood fuel "gun" for initiating combustion of wood type fuel fragments in the wood fuel "gun".

A further object of the invention is to provide a retrofitting furnace system for firing conventional furnaces with wood type fuel fragments by trickle feeding and combusting such fuel at a rate to produce substantially the heat equivalence of the oil burner gun associated with said conventional furnace. The invention also seeks to provide high temperature and efficient combustion of the wood fuel, automatic control over the feeding and firing process, and safety features attendant upon the problems of continuous feeding and combusting of wood fuel fragments. By these expedients the invention permits combustion of wood in central heating furnaces with the incidents and advantages of oil fired systems.

It is also an object of the invention to provide a furnace system which is adapted not only for retrofitting conventional oil fired furnaces, but also for operation as an independent furnace system when provided with its own heat exchanger, either the hot air, hot water or steam type.

SUMMARY OF THE INVENTION

In order to accomplish these results the present invention contemplates providing a wood type fuel combustion chamber formed by an enclosure of refractory material for efficient combustion of the wood type fuel at elevated temperatures to substantially complete combustion. Wood type fuel fragment feeding or conveying arrangements trickle feed the wood fuel fragments at selected rates, introducing the trickle fed fragments into the wood type fuel combustion chamber. According to the invention there is also provided a novel flame tube adapter for coupling the wood type fuel combustion chamber with the oil combustion chamber of a conventional oil fired furnace to be retrofitted. The oil furnace motor and firing gun is therefore first removed from the conventional oil furnace and the flame tube adapter received in its place. The wood fuel combustion chamber is constructed and arranged to receive the oil burner gun for igniting the fragmented wood type fuel during the start-up of the retrofitted furnace system. Blower means is provided in the system to established forced draft at least during the start-up of the wood fuel firing. The invention also contemplates provision of automatic controls for controlling and sequencing operation of the elements of the retrofitting furnace system.

When operating as an independent furnace system, the invention contemplates providing a separate heat exchanger into which the flame tube adapter is coupled rather than the oil combustion chamber and heat exchanger of the retrofitted furnace system with all other elements and features the same.

In a preferred embodiment of the invention the wood fuel combustion chamber comprises an enclosure of refractory material with divider means forming a primary combustion section and an afterburner section within the enclosure, and a combustion grate mounted in the primary combustion section for receiving the fragments of wood type fuel and for supporting the combusting fuel. The enclosure is formed with an opening at the top over the combustion grate for gravity delivery of the fuel onto the grate, a combustion air inlet at a level below the grate so that combustion air passes through the combustion grate from below, and a draft outlet spaced from the grate in the afterburner section for delivering hot gases to the flame tube. These various elements of the wood fuel combustion chamber are scaled and related, and the wood feeding means constructed and arranged to trickle feed the wood fuel fragments, to produce upon combustion in the chamber, substantially the heat equivalence of the domestic oil burner gun motor and firing means and with high efficiency.

The novel flame tube adapter of the present invention is adapted to extend from the wood fuel combustion chamber outlet and penetrate directly into the oil combustion chamber of the oil furnace to be retrofitted through the opening left after removal of the oil gun. This flame tube coupler is provided with selected length calculated to afford substantially complete combustion of the exhaust gases passing from the wood fuel combustion chamber while maintaining sufficient temperature to radiate heat directly into the oil furnace combustion chamber and heat exchanger plenum. As hereafter more fully set forth in the specification, the flame tube adapter is also scaled in relation to the other elements of the wood fuel "gun" for heat delivery in the approximate range of the original oil furnace.

At the inlet side of the wood fuel combustion chamber may be mounted and fitted the oil gun removed from the oil furnace for use in initiating combustion of the fragmented wood type fuels which oil gun is automatically cut off once sustained combustion is established. Also at the inlet or on the oil gun a blower may be provided for forcing excess combustion air through the combustion chamber and grate to the end of achieving more complete combustion.

According to a preferred embodiment the invention also contemplates providing wood type fuel feeding arrangements including a wood fuel fragment storage bin, a first trickle feeder for trickle feeding wood fuel fragments from the storage bin, and a second wood type fuel trickle feeder having an inlet end spaced from the first trickle feeder to form a first break in the continuity of the wood fuel fragments fed to the wood fuel combustion chamber. The inlet end of the second trickle feeding means is positioned to receive wood fuel fragments across the break from the first trickle feeding conveyor, while the outlet end is positioned over the wood fuel combustion chamber to form a second break in the continuity of the fuel line. Thus, the second trickle feeder delivers the fragments of wood type fuel across the second break into the combustion chamber and the fuel storage bin. The fuel storage bin and wood fuel fragment feeders are further designed to meet the peculiar problems associated with handling wood chips and wood fuel fragments including bridging and jamming.

The invention further contemplates a variety of control arrangements for controlling and sequencing the operation of the elements of the retrofitting furnace system upon retrofitting a conventional oil fired furnace. According to one aspect of the invention the controls include a conventional oil furnace controller switch of the kind having a motor contact and an ignition contact responsive to a thermostat or other thermal switch for opening and closing the contacts. The wood fuel trickle feeders are connected to the motor side of the intermittent ignition oil switch while the oil burner gun motor and arc now mounted on the wood fuel combustion chamber are connected to the ignition side of the switch. A delay element in the line to the oil gun delays ignition of the wood chip fuel until draft has been established through the wood fuel combustion chamber and oil furnace and fuel fragments delivered to the combustion grate. Furthermore, it has been found advantageous to provide an induced draft fan in the flue stack outlet of the furnace coupled to the controller switch for inducing and establishing draft through the system during the delay before ignition of the wood fuel by the oil gun.

A variety of other control and safety arrangements are also contemplated by the invention for the retrofitted furnace system. By way of example a thermally actuated stack switch is included in the system for sensing temperature in the draft through the stack and at a first threshold temperature, indicating establishment of sustained wood fuel combustion, cutting off the oil gun motor and arc. At a second threshold temperature such stack switch may be used to shut down the system to avoid overheating. A similar thermally responsive switch in the fuel feeding lines particularly over the wood fuel combustion chamber may be used to shut down the system in the event combustion advances into the fuel line. A sprinkler head may also be actuated to douse any undesired fire. The overall effect and result of the control arrangements and safety features contemplated by the present invention is to permit the combustion of alternative wood fuel in central heating furnaces with all the incidents and advantages normally only associated with oil fire systems.

For use as fuel in the retrofitting furnace system the present invention contemplates the use of wood chips either green or dried, the chipped wood coming from a variety of sources. In addition, the invention provides for the use of so called "hogged" wood fuel and any other form of fragmented wood of sizes in the range comparable to wood chips where the fragments are within a limited size range for handling by the fuel fragment handling and feeding system as hereafter more fully described. Thus, the furnace system of the present invention may also utilize as a fuel wood pellets and pelletized wood products such as those produced from wood waste material by Woodex of Maine in Lincoln, Maine. Because of the variety of forms such cellulosic materials and pellets may take, the fuels contemplated for use in the present invention are referred to broadly herein and in the claims as "wood type fuel" intending to include all the foregoing wood and cellulosic fuel materials. Furthermore because of the variety of shapes the fuel may take from chips to pellets to "hogged" pieces, such wood fuel pieces are referred to broadly and generally herein as wood fuel fragments intending and meaning to include all the foregoing forms of wood fuel particles in the size range comparable to wood chips.

Other objects features and advantages of the "wood fuel gun" contemplated by the present invention for retrofitting conventional oil furnaces and replacing the conventional oil gun motor and arc or displacing it one stage for use only in initiating combustion of the wood fuel fragments is more fully set forth in the following specification and accompanying drawings.

PRIOR ART STATEMENT

U.S. Pat. No. 273,421 describes an attachment for steam boiler furnaces for conveying and feeding straw from a strawbox into the combustion chamber of the furnace which has been adapted for burning straw as the fuel. A secondary combustion region into which preheated air is discharged is also provided for complete combustion of floating straw particles. It appears that the primary draft air passes up through the fire box grate upon which the straw falls from the feeder. While some of these features bear a resemblance to those in the present retrofitting wood chip or wood type fuel fragment furnace, the problems of burning straw are quite different, such as the rollers for feeding the straw fuel. Furthermore, the combustion chamber is not part of the attachment, and the modified furnace chamber is used for combustion. There is no correlate of the wood flame tube adapter of the present invention nor are the problems of handling wood chips addressed. Another straw or hay fuel feeding furnace is found in U.S. Pat. No. 214,799, but this is quite different using a spring loaded cartridge.

U.S. Pat. No. 2,092,680 describes a sawdust burner for retrofitting domestic heating units. In the example described in this patent a domestic range or stove is fitted with the sawdust burning adapter which includes the sawdust feed arrangement and primary sawdust combustion chamber. According to the disclosure the retrofitted sawdust burning unit is provided with refractory lined combustion chamber in which a grate is supported. The sawdust fuel falls from a hopper onto the grate for combusting and the primary combustion air from a damper passes upward through the grate from below. The products of combustion pass upward through a cylinder or tube in the fire box of the range or stove where additional air is injected for secondary combustion. The secondary air is preheated in this conventional fire box prior to mixing with the products of combustion. The inventor states that while his device is described as a sawdust burner, it can be used for coal and other suitable fuels also. While again some of these features bear a superficial resemblance to the wood chip retrofitting burner, the patent deals primarily with the problems of handling sawdust and carries out secondary combustion in the fire box space of the retrofitted heating unit. The problems of dealing with wood chips are not addressed nor is there any correlate of the wood fuel gun and flame tube adapter concept.

U.S. Pat. No. 1,618,501 describes an attachment for domestic heating plants for feeding and delivering mill waste fuel directly into the furnace combustion chamber. The grate is adapted for receiving the saw mill waste and permitting entrance of air upward through the grate during burning. There is no combustion chamber in the retrofitted adapter outside the furnace and the patent merely contemplates fitting the automatic feeder onto the furnace door.

Much of the prior art deals with coal handling feeding and combustion, and while bearing some analogy these patents are not directed to the problems of burning wood in the form of chips. U.S. Pat. No. 910,305 describes a continuous screw conveyor coal feeder, flange fitted to the conventional coal burning furnace. Another coal feeding mechanism is described in U.S. Pat. No. 1,203,167. Such screw conveyor arrangements are adapted for delivering fuel from a magazine located above or at the side of the furnace chamber and do not disclose or contemplate the safety arrangements of the wood fuel feeding system of the present invention.

U.S. Pat. No. 1,753,050 describes an interesting coal feeding attachment for feeding and stoking furnaces automatically, delivering coal or other fuel from a hopper to the furnace chamber. The hopper is provided with a wall agitator to prevent overarching of the fuel over the conveyor, a problem which similarly occurs with wood chips. Again, however, the wood fuel feeding arrangement of the present invention is not disclosed.

The closest prior art known to applicants is in fact not found in the patent literature but is rather found in the commercial and institutional scale wood chip furnaces developed by applicants and others at the University of Maine Agricultural Engineering Department and subject of publications and public installations and demonstrations over the past few years. A description of the more pertinent earlier work is found in Paper No. NA76-101 of the American Society of Agricultural Engineers, St. Joseph, Mich. 49085, presented by Professor John G. Riley, one of the applicants herein, at the 1976 Annual Meeting of the North Atlantic Region of ASAE held in Rutgers University, New Brunswick, N.J. on Aug. 15–18, 1976 and entitled "Development of a Small Institutional Heating Plant to Utilize Forest Residue Fuels". More recent work is summarized in Paper No. 79-1608 of ASAE presented by Professors John G. Riley, Mr. D. A. Smyth, and Professor Norman Smith, all of the Agricultural Engineering Department of the University of Maine at Orono, at the ASAE 1979 winter meeting held Dec. 11–14, 1979 in New Orleans, LA.

Each of the prior art units described in these publications or publicly or commercially installed however, is quite different in important respects from the present invention. These prior chip wood fired units provide self contained and complete systems on a scale greater than average domestic residential requirements. They are intended to stand alone and include all the elements of a furnace system. The present invention on the other hand is intended for retrofitting conventional oil furnaces and at the scale of average domestic heating requirements. As explained in the latter paper above downsizing for residential use was not a simple matter of scaling down the commercial and institutional scale units previously developed to a size suitable for residential use in the range of 50,000 to 100,000 BTU/hr, as such scaling could not be done economically, nor would it be suitable for retrofitting existing furnaces. Rather, a new and simpler design which may be fabricated at a cost comparable with the conventional furnace was developed by the inventors herein.

Thus, the present invention contemplates novel interfacing features such as the flame tube adapter for use in retrofitting conventional oil furnaces, novel scaling and proportional relationships between the wood fuel combustion chamber elements, novel wood fuel fragment feeding and handling arrangements, a compact "wood fuel gun" substitute for the conventional oil burner gun, unique integration with the conventional oil furnace for a retrofitted furnace system, and methods of operation and control apparatus peculiarly adapted and suitable for the small residential wood chip furnace application contemplated by the present invention. Thus, the residential scale wood fuel fragment firing and retrofitting furnace system herein described and claimed is based upon new and unobvious concepts not presented by applicants own generated prior art.

DESCRIPTION OF THE PREFERRED EXAMPLE EMBODIMENTS

Figure 1:
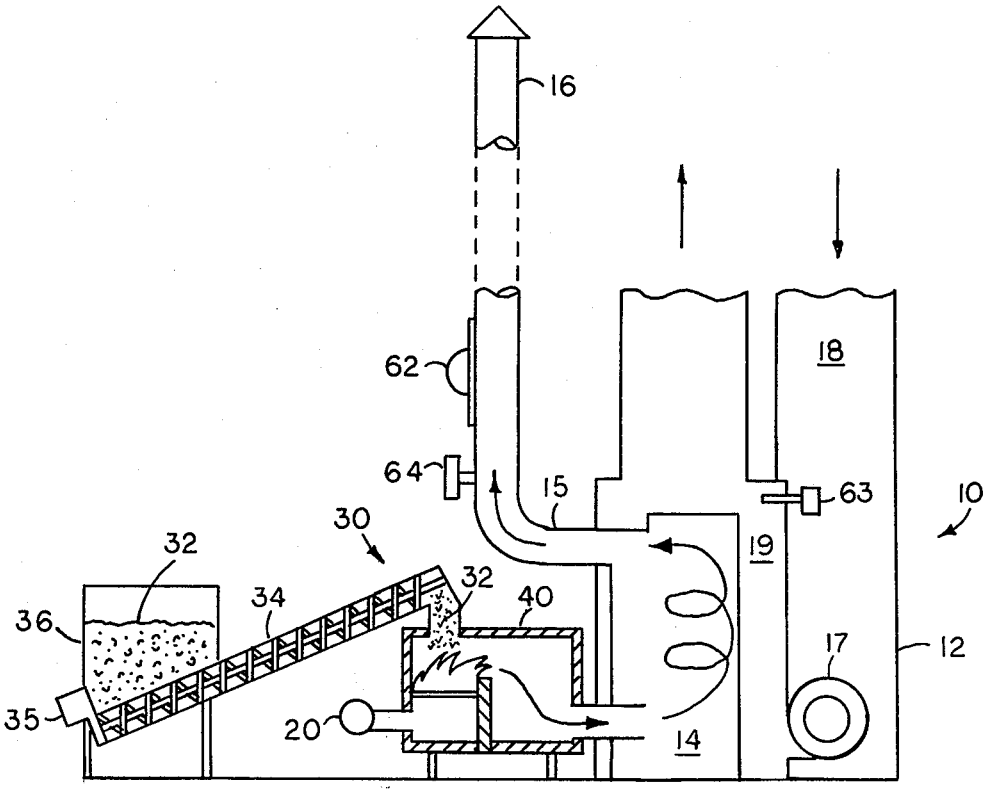
FIG. 1 is a diagrammatic side cross sectional view of a conventional oil furnace retrofitted with the retrofitting furnace system or "wood fuel gun" according to the present invention for combustion and heating with fragmented wood type fuels in lieu of petroleum fuels.

A furnace system retrofitted in accordance with the present invention is shown in the diagrammatic side cross section view of FIG. 1. The complete retrofitted furnace system 10 includes a conventional central heating household furnace 12 of the oil fired hot air type. Thus, the furnace 12 includes an oil combustion chamber 14 and exhaust flue 15 leading to chimney 16. Blower 17 draws retrun air from conduit 18 through the heat exchanger 19 where the return air is brought into heat exchange relationship with combustion chamber 14 and flue 15 and related heat exchange surface areas. Unlike a conventional oil fired furnace however, the oil "gun" 20 has been removed from its normal position firing into the oil combustion chamber 14 and has been replaced by a "wood chip gun" or "wood fuel gun" 30 coupled to the conventional furnace 12 for delivering wood fuel derived heat instead of oil fuel derived heat, into the chamber 14.

The wood fuel gun or wood chip gun 30 includes a wood fuel combustion chamber 40 for efficient and substantially complete combustion of fragmented wood type fuels such as wood chips, wood or cellulose material pellets, hogged wood etc. The fragmented wood type fuel 32 is delivered to the top of the wood fuel combustion chamber 40 for gravity feed into the chamber 40. Screw conveyor or auger 34 slowly and continuously "trickle" feeds the fragmented wood pieces at the desired rate, to produce the desired heat output. Augur 34 is driven by motor 35. The wood fuel 32 is stored in the storage bin 36 which may be of variable size according to the number of days fuel use desired to be held in storage, typically several days.

Figure 2:
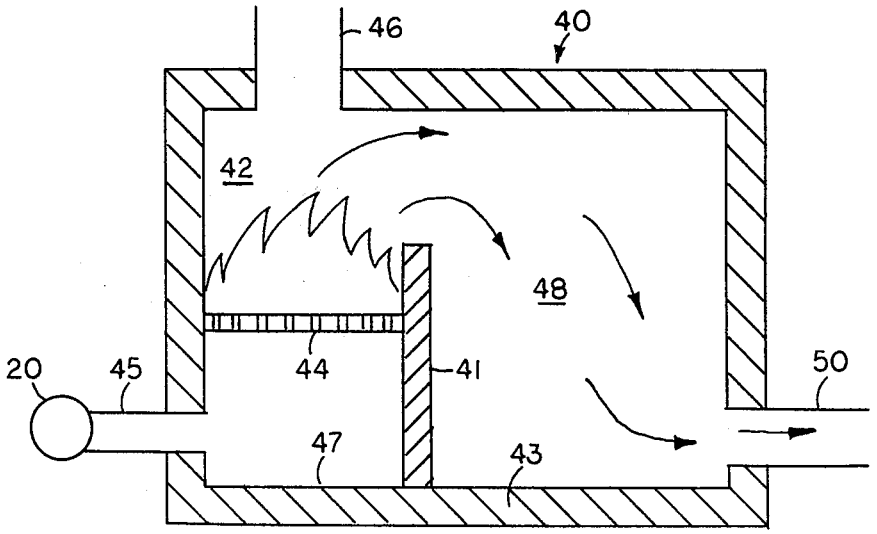
FIG. 2 is a detailed side cross section of a wood type combustion chamber of refractory material for use in the retrofitting furnace system and showing the combustion grate, primary combustion section, after burner section, and oil gun mounted in the combustion chamber for initiating combustion of the solid wood type fuel.

The wood fuel combustion chamber 40 shown in more detail in FIG. 2 generally comprises a refractory lined box or box made of refractory brick material, and is divided into two compartments or regions by baffle 41. The fragmented wood type fuel is received in the combustion region 42 on a combustion grate 44 supported in the combustion region 42 and spaced above the base 43 of the combustion chamber 40. Combustion air intake passageway 45 formed in the wall of the chamber is positioned below the grate so that as much of the combustion air as possible passes upwardly through the grate 44. Wood fuel fragments trickle feed from the augur above by gravity through overhead passageway 46 and are received on the grate where the burning fuel is supported. The upward flow of combustion air through the grate 44 produces an intense fire which allows green chips to be burned. The turbulence and mixing from the upward draft permits the highest energy release from the wood combustion with the smallest fire and grate area. Additionally, the cooling effect of the upward draft increases grate life and keeps any ash on the grate below the temperature at which it will fuse and form slag. The ash will thus continue to fall through the grate into the ash pit 47 as new chips falling onto the grate disturb the fire mass.

The other compartment or chamber of the wood fuel combustion chamber box 40 is the afterburner region 48 which provides sufficient turbulence and retention time at high temperature in the refractory environment to ensure substantially complete combustion before the flue gases leave the firebox and begin to be cooled. The hot gaseous products of combustion exit from the combustion chamber through a flame tube adapter 50 which couples the output of the wood fuel combustion chamber 40 into the combustion chamber of the conventional but retrofitted oil furnace 10 as hereafter more fully described.

Combustion of wood fuel received and supported on grate 44 within the wood fuel combustion chamber 40 is initiated by the oil gun 20 which includes the oil pump motor and ignition firing arc all removed from the conventional furnace. Thus, the oil gun 20 has been removed one stage from the oil furnace and is mounted on the wood fuel combustion chamber through passageway 45 below the combustion grate for igniting fragmented wood type fuel during start up of the retrofitted furnace system. A blower may be mounted on the oil gun for forcing air into the combustion region and through the grate. It should be noted that the gravity feed of wood chips or other fragmented wood type fuel from the wood fuel feed mechanism through passageway 46 and down to the surface of the grate 44 provides a break in the fuel path to prevent ignition, pyrolysis or combustion from climbing up the fuel into the fuel supply in the augur or other fuel feeding arrangement and the fuel storage bin.

A positive draft pressure differential is established through the retrofitted furnace system by induced draft fan 62 mounted in the stack. The positive draft established through the system assures that combustion air will be drawn through the grate 44 in the wood fuel combustion chamber and that smoke will not enter the fuel supply line and fuel feeding mechanism. Slightly excess air is admitted through passageway 45 to assure substantially complete combustion but excess is limited to maintain the low pressure in the combustion chamber 40. Fan switch 63 controls furnace blower 17 for circulating heated air to the living spaces. Stack switch 64 controls turn on of the induced draft fan 62, oil burner motor and igniter 20, and the fuel feeding augur motor 35.

Figure 3:
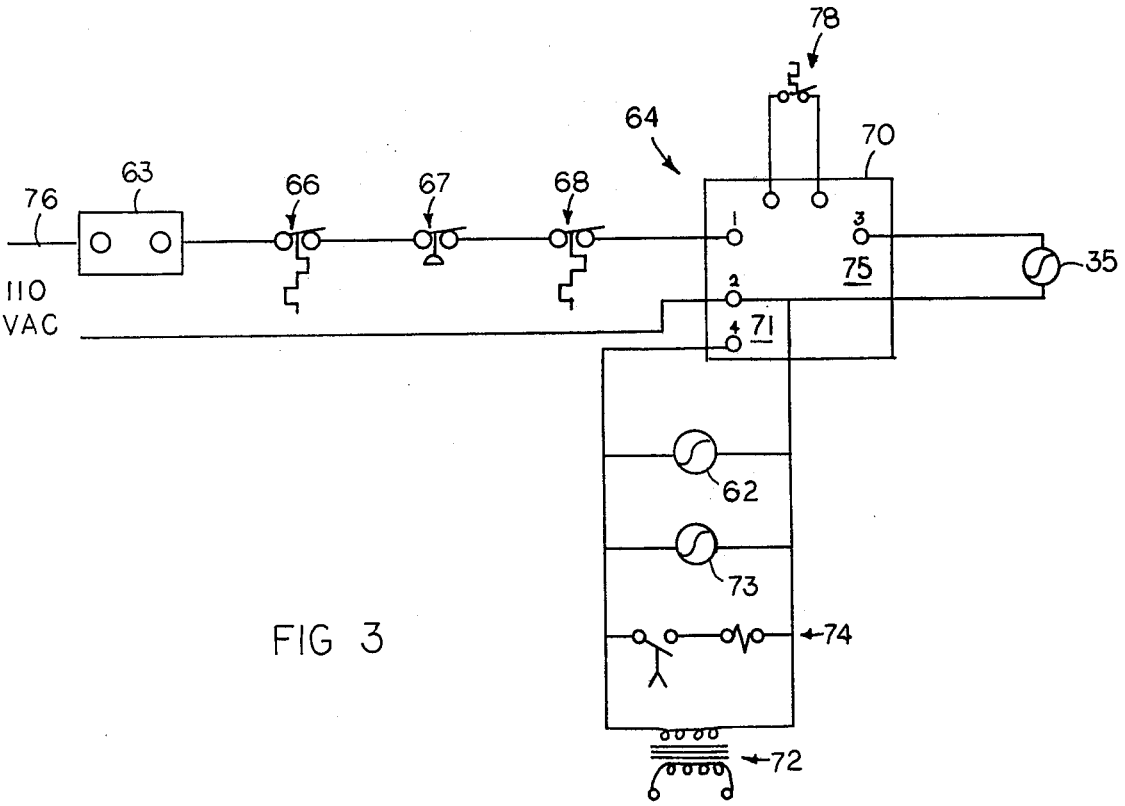
FIG. 3 is a schematic diagram of an automatic control system for the retrofitting furnace system.

Additional elements and coupling of the control system for the retrofitted furnace system not illustrated in FIG. 1 are shown in further detail in the schematic diagram of FIG. 3 and hereafter described. The operating sequence of the retrofitted furnace system may then be described with reference to the control system of FIG. 3 and the diagram of FIG. 1. Referring to FIG. 3, stack switch 64 may be a conventional intermittent ignition stack relay switch 70 such as, for example a Honeywell Model RA 117 or RA 817 mounted with a thermal sensor in the stack. This conventional switch is coupled into the control circuitry for the retrofitted furnace system in an unconventional manner, however. The ignition side 71 of relay switch 70, normally coupled only to the ignition of the oil burner gun, is coupled to control not only the oil burner arc ignition transformer 72, but also the oil burner motor 73, and the induced draft fan motor 62. These elements are coupled in parallel. Oil burner ignition 72 and motor 73 together comprise the oil burner gun 20. A time delay 74 such as a time delay oil valve is coupled in parallel with the foregoing elements and provides a 6 second time delay before oil ignition in order to allow the draft inducing fan to come up to speed and establish a pressure differential with vacuum in the wood fuel combustion chamber and draft through the system to the stack. The motor contact side 75 of switch 70, normally coupled to the oil burner gun motor is coupled to the fragmented wood fuel feed mechanism drive motor for continuous trickle feed of wood fuel fragments at the desired rate into the combustion region 42 of box 40. Thus, the oil burner gun 20 is coupled as the igniter, with the "wood chip gun" 30 coupled as the sustained fuel feeder and burner.

Power such as 110 volts AC supplied to switch 70 over line 76 also supplies power to the air circulating fan 17 through fan switch 63 which circulates environmental air through the heat exchanger and to the spaces to be heated when a high limit temperature is sensed in the heat exchanger in the conventional manner. The power to switch 70 is controlled by a series of safety switches included in the furnace system. A thermal cut-off switch 66 is positioned in the fuel feeding tube 34 near the top for sensing the occurrence of heat flow into the fuel feeding line. The thermal cut-off switch 66 may be set, for example to cut off power to the main switch 70 if the temperature in the fuel feed line exceeds 165°–175° F. This situation might occur if the induced draft fan failed to operate and proper draft were not established. The system would then shut down. Fuel tube blockage cut-off switch 67 is also positioned at the head of the fuel feeding augur tube 34 to respond to pressure from wood fuel fragments or chips jamming against the end of the fuel tube 34. This pressure switch responds to a blockage at the top of the fuel feeding line by cutting off power to switch 70 and shutting down the system including the fuel conveyor motor 35, until the blockage can be removed. Finally, an oil burner thermal cut-off switch 68 may be positioned over the oil burner gun to sense the occurrence of a fire in the vicinity of the gun and shut down the system. While these elements are not shown in FIG. 1, they will be further described subsequently with reference to the embodiment of the invention illustrated in FIG. 5.

According to the operating sequence of the retrofitted furnace system in accordance with the present invention for a hot air system, thermostat 78 (FIG. 3) positioned in the living space or other space to be heated calls for heat closing the contacts of main switch 70. This turns on the draft inducing fan 62, oil burner gun motor and igniter 20 after time delay, and wood fuel chip feed motor 35. As the wood fragment fuel is ignited and sustained combustion established, temperature rises in the flue outlet, and the thermal sensor of switch 70 positioned in the stack turns off the igniter side 71 of switch 70 thereby cutting off the oil burner gun and draft inducing fan at a preselected temperature in the stack indicating in fact that sustained wood fuel combustion has been established. If the natural draft of the chimney is insufficient to maintain the pressure differential through the furnace system, the induced draft fan 62 may be coupled to the motor side 75 of switch 70 so that it remains on whenever wood chips are being fed to the wood fuel combustion chamber. Bonnet switch 63 turns on the air circulator fan 17 when the temperature in the vicinity of heat exchanger 19 has reached the desired temperature for heat exchange and air circulation for heating. When the temperature in the space to be heated satisfies the thermostat 78, relay switch 70 turns off the wood fuel chip feed motor 35, and the fire on the grate burns out in about ten minutes. The bonnet switch 63 turns off the circulating fan 17 at a present low limit temperature.

For a hot water circulating system the bonnet switch and thermal sensor 63 would be replaced with an aquastat having a high limit temperature and set to circulate water through the radiator system when the temperature reaches the desired level.

The control system elements and coupling including the main switch 70 and safety switches afford a variety of logical sequences in response to malfunction. If the oil burner gun 20 fails to ignite and thereby raise the stack temperature within a predetermined time, the stack switch 70 of the type heretofore described shuts down the system in the conventional manner. The built in safety feature in such a switch shutting down the system is bypassed only if sufficient temperature is sensed in the stack. If the induced draft fan fails to operate and the chimney does not draw, heat from the oil burner gun 20 rises up into fuel line and trickle feed augur tube 34 actuating the 165°–175° F. thermal safety switch 66, again shutting down the system. For the situation where the wood chips or other fragmented wood fuel have already ignited with induced draft fan inoperative, an additional safety feature in the form of a sprinkler head in the fuel line over the combustion grate can be added set to release, for example, a gallon of water into the firebox to drown the fire, if the temperature in the fuel feeding tube 34 reaches 225° F. Such an arrangment is described with reference to FIG. 5A for the embodiment illustrated in FIG. 5.

If the oil burner gun 20 has an internal fire, the thermal safety switch 68 positioned over the oil burner shuts down the system. A fusable link is included to shut off the oil control valve in the conventional manner. If the wood fuel feed rate becomes excessive and the combustion heat in turn excessive, the high temperature limit on the bonnet switch 63 or aquastat in the case of a water system is coupled to cut off electricity to the stack switch 64, 70, cutting off the fuel feed motor and preventing further supply of fuel until the stack control switch 70 recycles and begins the complete operating sequence again.

If the wood fuel supply becomes exhausted or there is a blockage or interruption in the fuel feed further down the line causing a reduced fire, the drop in stack temperature is sensed by the thermal sensor of stack switch 70 whose safety feature turns off the fuel supply until the operating sequence recycles and begins again under control of the stack switch. When the operating sequence begins again the lack of wood fuel may have two results. With a small nozzle on the oil burner, insufficient heat will be generated and sensed in the stack and the oil burner will again be shut off and remain off, because there is insufficient heat to bypass the built in safety in stack switch 70. With a larger nozzle, sufficient heat may be generated to permit the furnace system to "stand by" on oil with the oil burner gun cycling on and off. During each cycle the oil burner ignites and generates sufficient heat to be shut off in the cyclic mode but bypassing the safety for reignition.

A chip fuel blockage at the top of the fuel feed augur which prevents fuel from reaching the firebox 40, actuates the pressure switch 67 at the top end of the fuel conveyor tube 34 and shuts down the chip feed motor 35, until the blockage is removed and free passage restored. The lack of fuel and drop in stack temperature will also result in the sequencing of operation described in the preceding paragraph as in the case of fuel exhaustion or a blockage further down the line.

Finally, in the event of power failure, all electrical devices stop and system shuts down. Existing fire on the combustion grate burns out in about ten minutes by natural chimney draft. If the power failure occurs with a cold chimney and inadequate draft during initiation of combustion, and if the wood fuel chips are ignited, the rise of temperature in the fuel feeding line and tube 34 to 225° will trip the optional sprinkler head and release a gallon of water into the firebox.

Figure 4:
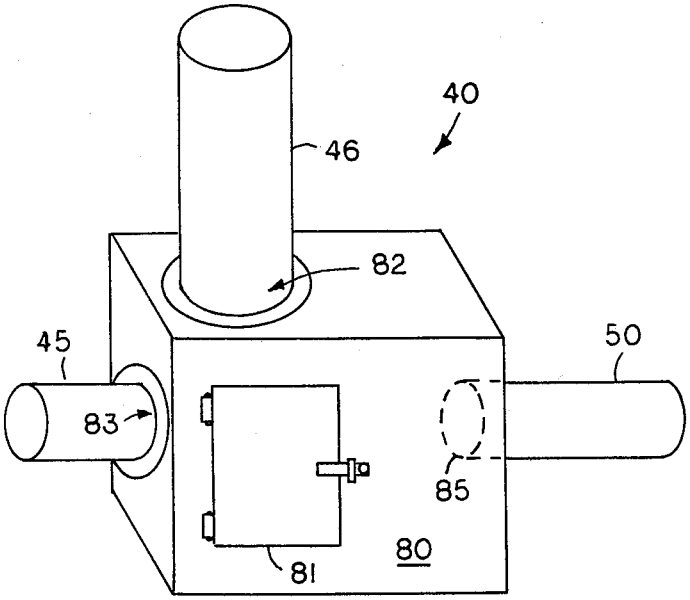
FIG. 4 is a perspective view of the wood fuel combustion chamber and enclosure showing the combustion air inlet, hot draft outlet, and passageway and opening above for feeding wood fuel fragments there through onto the combustion grate.

A perspective view of the wood fuel combustion chamber firebox 40 is shown in FIG. 4. The combustion chamber walls formed of cast refractory material or refractory brick, and other internal elements as described with reference to FIG. 2 are enclosed within an air tight enclosure 80 of welded or bolted boiler plate or mild steel such as 16 gauge steel. The refractory material or brick lining within steel container 80 is of the insulating type capable of withstanding temperature of, for example 3000° F., and wood fuel combustion generally takes place in the temperature range of 1400°–2200° F. ensuring substantially complete combustion of the wood fuel constituents. The steel container includes a hinged door 81 for access and clean out; overhead opening 82 for fuel passageway 46 through which the trickle feeding fuel fragments fall by gravity onto the combustion grate; inlet opening 83 for oil gun and combustion air passageway 45 which is bolted to the steel container by an asbestos gasket and flange 84; and outlet opening 85 through which the close fitting flame tube adapter 50 is inserted into the afterburner portion of the firebox 40. The flame tube adapter 50 extends into the firebox at one end and into the oil combustion chamber of the conventional oil furnace 12 at the other end and may be coupled to the wall of each by pressure flange and asbestos gasket.

The firebox is sized for wood fuel combustion and heat delivery in the range of 50,000 to 100,000 BTU/Hr., comparable to the heat output of the oil furnace 12 which has been retrofitted. To achieve this range of heat output the firebox is scaled for combustion of wood fuel fragments at the rate of 8–20 lbs./hr. comparable to a fuel consumption range for oil of ½–1 gal./hr. The wood fuel combustion rate for a desired heat output depends upon the type of wood and moisture content of the wood. Thus, substantially dry hardwood chips at 9 lbs./hr may deliver 60,000 BTU/hr. If the chips are wet, 18 lbs./hr. may be required to deliver the same heat output. As a rule of thumb substantially dry wood chips afford heat output upon combustion of approximately 6500 BTU/lb.

The outside dimensions of the firebox in this example of domestic scale furnace application are approximately 18 inches length, 13½–14 inches height and 11½–12 inches width, the refractory lining material inside the walls, top and bottom being approximately 2 inches in thickness. The fuel tube 46 is approximately 6 inches in diameter while the oil burner gun and combustion air inlet tube 45 and flame tube adapter coupler 50 are approximately 4 inches in diameter and made of refractory material. An ash pit (not shown in FIG. 4) is provided at the bottom of the combustion side of the firebox for removal of ashes, visible in the example of the invention illustrated in FIG. 5 and hereafter described.

Figure 4A:
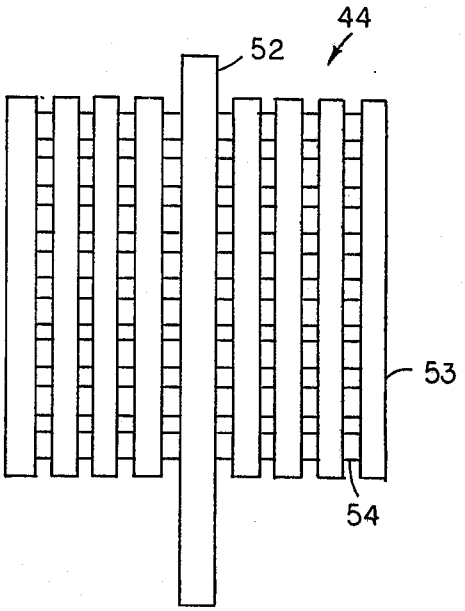
FIG. 4A is a plan view from above looking down on the combustion grate which receives the wood fuel fragments, and supports them during combustion.

Directing attention to the grate 44 mounted within the combustion side of the firebox 40 as shown in FIG. 2, with a detail plan view in FIG. 4A, the grate may be constructed of cast iron bar or pipe, for example, a section of radiator piping, permitting free flow of air throughout the area of the grate. In this example the grate area is approximately 6.5"×6.5" substantially completely covering the horizontal cross-sectional area of the combustion section 42 of the firebox 40 as determined by the location of baffle or divider wall 41. This wall may be moved to adjust for different size grates.

It has been determined that with wood fuel fireboxes and combustion grates of this type the heat output is a function of the area size of the fire and therefore the area size of the grate in the proportion of approximately 2000 BTU/hr. per square inch of grate or 2000 BTU/hr./in.$^2$. With hardwood chips feeding at the rate of approximately 12 lbs./hr. a grate size 6.5"×6.5" provides a surface area of approximately 40 square inches and an output of approximately 80,000 BTU/hr. Thus, the grate area size is matched with the fuel feed rate heat equivalent. For smaller grate area size the chips tend to pile up and obstruct passage or flow of air through the grate and the primary combustion exhaust mixture is too rich. For larger grate area the air flow is excessive and the resulting mixture too lean. Matching the grate area size to fuel feeding rate provides the optimum combustion efficiency for a particular level of heat output. For example, for a heat output of 100,000 BTU/hr. requiring fuel feed rates of 15 lbs/hr. and greater, the grate size would be, for example, 6.5"×8" providing a surface area approximately 50 in.$^2$. The divider wall 41 may be a stack of refractory brick which may be moved and adjusted to accommodate the size of the grate.

The grate 44 is supported in the combustion section of the firebox on an elongate central axis pipe or rod 52 which extends into or through the firebox sidewalls. The crossed pipe members 53 and 54 comprising the grate are in turn welded or otherwise connected to the central axis support 52. The grate may be rotated on the axis 52 and held in place in the combustion section between the divider wall 41 and end of the firebox by tabs or other suitable means. By the elongate axis mounting for rotation, the combustion grate forms a "butterfly" grate for dumping ashes into the ash pit.

The flame tube adapter or coupler 50 provides a novel means for coupling the heat output from the wood combustion chamber 40 into the oil combustion chamber 14 of the conventional furnace 12 as retrofitted in accordance with the present invention. The flame tube adapter serves a twofold purpose. On the one hand it affords sufficient length of travel time from the afterburner for substantial completion of secondary combustion of the flue gases. On the other hand it maintains sufficient temperature and extends into the oil furnace combustion chamber and heat exchange plenum for radiant heat exchange directly into the heat transfer surfaces of the conventional oil furnace. These twofold purposes place two constraints on the characteristic structure of the flame tube adapter 50. It must be long enough to provide a complete burn thereby to avoid sooting and creosote deposits in the oil furnace and subsequent flue gas pathway. Thus, it must be long enough to contain the afterburner section flame and prevent deposits inside the oil furnace. On the other hand it must be short enough to maximize temperature and radiant heat transfer from the flame tube 50 to the heat exchange surfaces in the furnace. A tube approximately 6" longer than the secondary flue gas combustion flame output from the afterburner section 48 of firebox 40 is generally sufficient. If the flame tube is too long the effectiveness of direct radiant heat transfer to the heat exchanger is reduced.

Figure 4B:
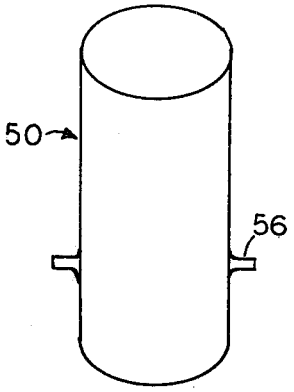
FIG. 4B is a detail perspective view from an angle above of the flame tube adapter.

It has been found that with a firebox 40 of the construction and arrangement described with reference to FIGS. 1–4, a 12" tube works well for wood fuel fragment feed rates of up to 10 lbs. per hour. As the wood fuel feed rate increases up to 12 lbs. per hour and greater, a 15" tube is preferable. Thus, the increased length matches the increased flame out the end of the afterburner and reduces deposits from incomplete combustion, while still maintaining radiant heat exchange in the oil furnace heat exchanger. The tube preferably extends at least 6" into the oil furnace chamber, and may be a telescoping tube with adjustable length for adjustment in length to match the fuel combustion rate. Optimum efficiency in combustion and heat transfer may therefore be maintained at different fuel feed rates and furnace outputs. The flame tube 50 as shown in FIG. 4B is made of 3/16 inch cast iron or preferably of a thin refractory material and if the length is properly adjusted as set forth above the end in the oil furnace chamber will be glowing and radiating. Tabs 56 provide supporting stops at appropriate distances along the length of the tube.

The cross sectional area of the flame tube adapter and coupler is similarly related to the heat output and therefore fuel feed rate of the wood fuel combustion "gun". It has been determined that flame tube cross sectional area of approximately 12 square inches is required per 100,000 BTU/hr. capacity output from the firebox combustion section through the secondary afterburner section and flame tube coupler 50. Thus, a flame tube approximately 4" in inner diameter affords the throughput to match the output of the domestic scale wood chip furnace retrofitting system of the present invention. While the flame tube adapter and coupler extends respectively at each end into the wood fuel combustion chamber afterburner on the one hand and the oil furnace chamber on the other it may be firmly attached to each by annular pressure flange and asbestos gasket.

Air flow through the combustion grate 44 from air inlet passageway 45 is generally in the range of 10 to 40 cubic feet per minute, which flow rate may be established by natural draft from a chimney with minimum height of 18 feet and stack temperatures of 250°–300° as would occur with the system described above. The general requirement for complete combustion is 6 lbs. of air per lb. of wood chips plus 50% excess air. If the natural chimney draft is insufficient to maintain this flow of air, the induced draft fan in the stack may be coupled to run continuously while the wood fuel is being fed into the combustion chamber 40. With combustion temperatures in the firebox maintained over 1200° F. a very efficient and clean burn is established.

Figure 5A:
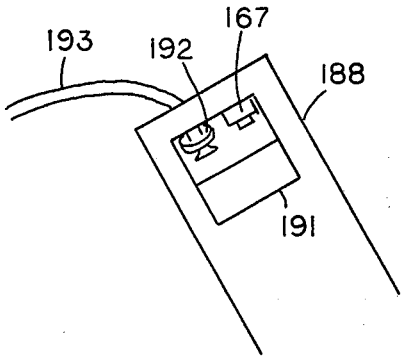
FIG. 5A is a detail fragmentary view of the top or outlet end of the second trickle feed auger showing the pressure limit switch and the safety sprinkler head.
Figure 5B:
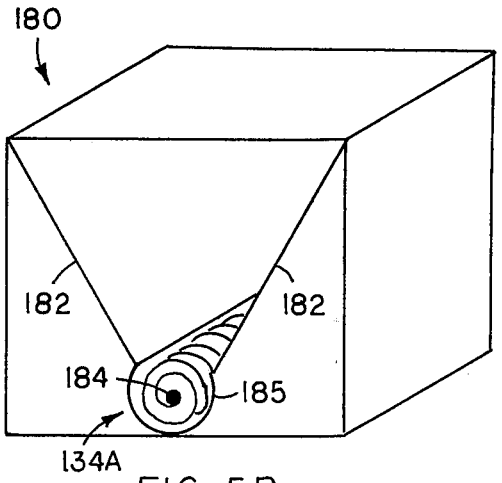
FIG. 5B is a partial perspective view with the front wall cut away of the wood fuel fragment storage bin.
Figure 5:
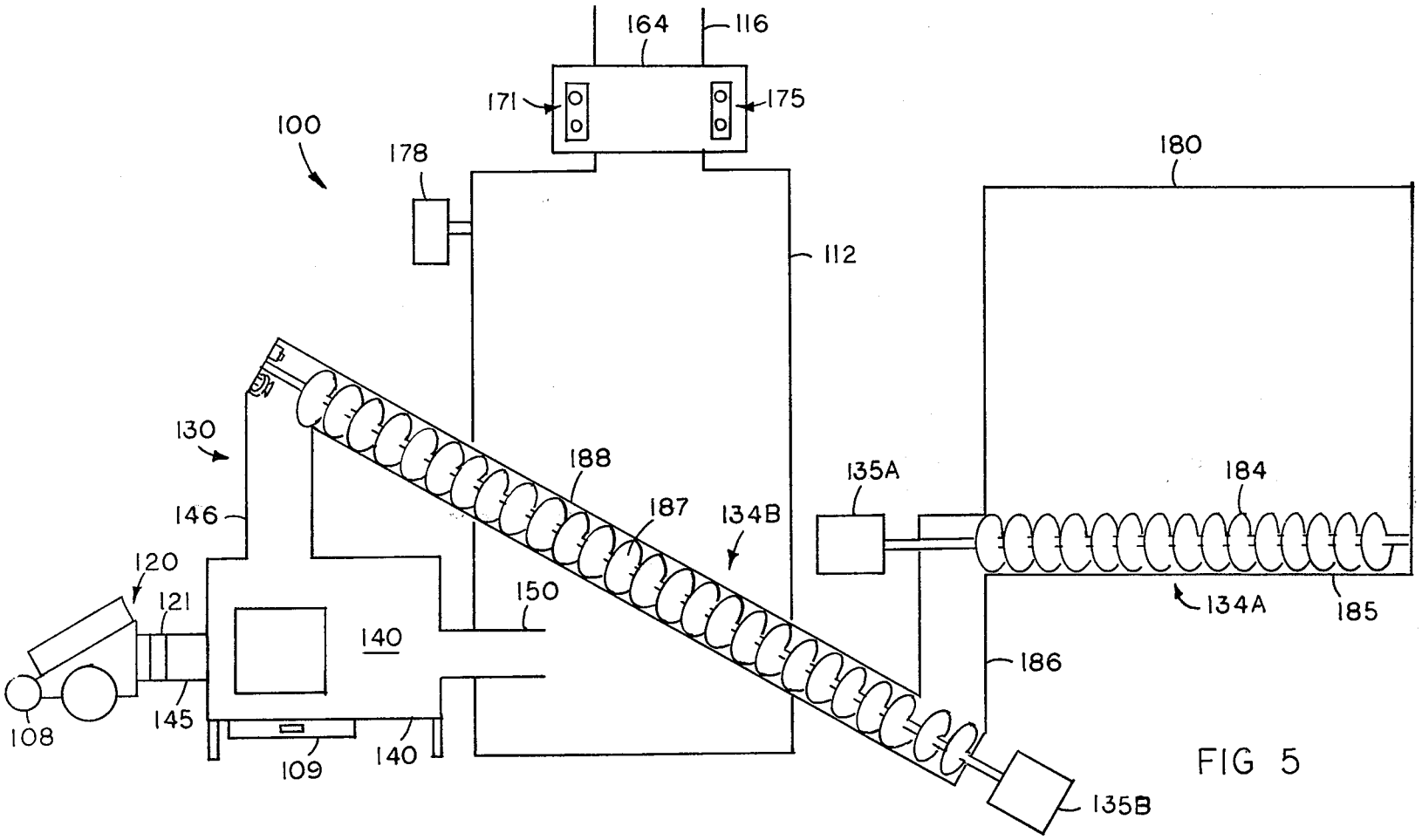
FIG. 5 is a diagrammatic side view partially cut away showing a complete retrofitted furnace system, retrofitted in accordance with the present invention.

A further understanding of the present invention may be gained from the complete retrofitted furnace system 100 illustrated in FIG. 5 which also shows additional features and modifications of the present invention. According to this embodiment the conventional oil fired furnace 112 from which oil burner motor and igniter gun 120 has been removed, is fitted with a wood fuel burner 130 as heretofore described. The retrofitting wood fuel burner 130 includes a wood fuel combustion chamber 140 of the kind described with reference to FIGS. 2 and 4 to which the oil burner motor and igniter 120 has been attached for igniting the wood fuel fragments all according to the sequence of control and operation described above. In this case, a forced air blower 108 has also been attached to the inlet tube 145 for additionally forcing air into the combustion section and through the combustion grate. The firebox 140 also shows the ash clean out pit 109. The oil burner nozzle is set back from the wood firebox and the heat of the combustion section a distance approximately 3" from the edge of the firebox. An asbestos gasket 121 couples the oil gun output to the inlet tube 145.

In this example the conventional oil furnace 112 is an oil fired hot water furnace with an aquastat 178 which senses the temperature circulating from the oil furnace. The flue exhaust from wood fuel combustion chamber 140 passes through the oil furnace chamber and heat exchanger to the stack 116 upon which is mounted the stack switch 164 of the kind heretofore described, for example, a Honeywell RA 117A. The run side 175 of intermittent ignition stack switch 164 controls both the motors 135A and 135B which in turn drive the trickle feeding wood fuel augur type conveyors 134A and 134B which together provide the active fuel feeding system for this embodiment of the invention as hereafter further described. The run side 175 of intermittent ignition stack switch 164 also controls the forced air blower 108 which provides the under fire air.

The ignition side 171 of stack switch 164 controls the oil burner motor and igniter and the induced draft fan located in stack 116 and not illustrated in FIG. 5.

Referring also to FIG. 5B the wood chips or other fragmented wood type fuels are stored in storage bin 180 which may be of varying size according to the number of days storage of fuel desired. A one day supply of wood chips for an average winter day in Maine amounts to approximately 18 cubic feet. The storage bin 180 is formed with internal sloping sidewalls 182 which form a 60° angle with the horizontal. The wood chips or other wood fuel fragments rest against the steep walls and slide progressively to the base in which is located a horizontal augur or screw feeding mechanism 184.

Thus, the walls of the bin form a steep walled funnel leading to the augur. In the preferred example for handling and feeding conventional wood chips the augur screw is 4 inches in diameter and is axially aligned and supported for totation within a half tube 185 with half circle cross section 6 inches in diameter. It has been determined that for proper jam-free operation the distance or spacing between the augur and tubular housing should be in the order of magnitude of the size of the fuel fragments fed by the screw conveyor. Thus, a four inch diameter augur within a six inch diameter tubular housing or enclosure has been found satisfactory for handling conventional wood chips. The 60 degree slope on each side of the bin avoids the problem of "bridging" in which the fuel fragments interlock and form a bridge over the conveyor. This problem has been successfully avoided with converging bin slopes of at least 60° with reference to the horizontal.

Referring back to FIG. 5 the wood fuel fragments fed by the first screw conveyor 134A drop through a vertical feed tube 186 to the base of the second screw conveyor 134B driven by motor 135B. The second screw conveyor 134B comprises an augur 187 four inches in diameter within tubular housing 188 which is six inches in diameter. The conveyor 134B is oriented at an angle to the horizontal to deliver the wood chips or other wood fuel fragments to a position over the wood fuel combustion chamber 140 where the wood chips fall by gravity through wood fuel inlet tube or passageway 146. The drive motors 135A and 135B for wood fuel conveyors 134A and 134B provide a rotational speed suitable for trickle feeding the wood chips at the desired rate of, for example, eight to twenty pounds of wood per hour. For example, to provide the fuel feeding rate of 10 lbs. per hour the augurs are set to rotate one revolution every one and one third minutes. In particular, the motors may be set to rotate at two rpm each turning an 18 tooth gear which in turn drives a 48 tooth gear connected to the axle of the augur.

By the use of two separate screw augur drives 134A and 134B two breaks are provided in the fuel line at vertical fuel tubes 186 and 146 thereby isolating the wood fuel storage bin 180 from the combustion zone within wood fuel combustion chamber 140.

At the head of tubular enclosure 188 for the inclined second augur 187 at least two safety features are provided shown in further detail in FIG. 5A. Thus, at the upper end of tubular housing 188 over firebox 140 is mounted a pressure switch 190 which responds to the pressure of wood fuel which may become jammed at the head of the conveyor and cuts off power to the furnace system as described with reference to limit switch 67 shown in FIG. 3. In this situation an operator would have to clear the jam before sequencing of operations of the furnace system could resume. A side door 191 in conveyor tube 188 is shown for that purpose. Also at the head of tube 188 is a sprinkler head 192 coupled to a source of water through hose 193 and adjusted to spray water down fuel inlet passageway 146 to douse the fire on the combustion grate if the temperature in the conveyor tube exceeds 225 F. A pressure switch similar to 167 may also be placed at the end of tube 185 housing augur 184, at the top of vertical fuel delivery tube 186 in the event a jam occurs at the end of the first fuel conveyor 134A. A variety of other arrangements may be provided for delivering wood chips from the storage bin including chain feeding mechanisms as described by Dan Smyth and John A. Riley in ASAE Paper 79-3514 delivered at the ASAE meeting in New Orleans, December 1979.

The sequence of operations of the furnace system and the system logic in response to malfunction is similar to that described above with reference to the FIGS. 1–4 once the aquastat calls for hot water from the furnace.

It is apparent that the present invention may be constructed with its own heat exchanger and heat exchange plenum without the conventional furnace system 12 of FIG. 1 and the conventional furnace system 112 of FIG. 5. Thus the present invention may be realized as an independent furnace system in which all the elements as in the systems of FIG. 1 and FIG. 5 are the same except that the flame tube adapter or coupler 50 or 150 respectively, couples into the plenum of an independent heat exchanger of either the hot air, hot water or steam type leading to the stack and mounted stack switch and controls as heretofore described, and all without the adjunct conventional furnace system. The final example embodiment of the invention here described is thus the same as that illustrated in FIG. 1 and FIG. 5 with the element 12 or 112 respectively, viewed as an independent heat exchanger and circulator or blower, with a plenum into which the flame tube adapter feeds and not as a conventional furnace. The FIGS. 1 and 5 therefore serve to illustrate also this independent embodiment of the invention with heat exchanger, circulator or blower, and plenum 12 or 112 for receiving the flame tube adapter instead of a conventional furnace system. The foregoing described coacting elements characterizing the invention in whatever embodiment are specified with this intended breadth in the following claims.

What is claimed is:

1. A new and improved residential or small scale retrofitting furnace system for automatically controlled continuous and efficient combustion of fragmented wood type fuels such as chipped, hogged, and pellitized wood, bark, wood waste and logging residues, said retrofitting furnace system adapted for utilizing and retrofitting conventional oil fired hot air and hot water furnace systems of the kind having an oil combustion chamber, heat exchanger, and oil burner gun motor and firing means, said new retrofitting furnace system comprising:

wood type fuel combustion chamber means formed by an enclosure of refractory material for efficient combustion of the wood type fuel at elevated temperatures to substantially complete combustion;

fragmented wood type fuel feeding means for trickle feeding wood fuel fragments at selected uniform rates and for introducing the trickle fed fuel fragments into the wood type fuel combustion chamber means;

flame tube adapter means for coupling the wood type fuel combustion chamber with the oil combustion chamber of a conventional oil fired furnace to be retrofitted after the oil burner gun motor and firing means has been removed from such conventional oil furnace;

said wood fuel combustion chamber means adapted to receive an oil burner gun motor and firing means removed from the conventional oil furnace for igniting the fragmented wood type fuel during start up of the retrofitting furnace system;

means for establishing a draft through the retrofitted furnace system during start up of the system;

and control means for controlling and sequencing operation of the elements of the retrofitting furnace system.

2. A new and improved retrofitting furnace system as set forth in claim 1 wherein said wood type fuel feeding means is constructed and arranged to trickle feed wood fuel fragments at a rate to produce, upon combustion in the wood fuel combustion chamber means, substantially the heat equivalence of the domestic oil burner gun motor and firing means.

3. A new and improved retrofitting furnace system as set forth in claim 1 wherein said wood type fuel combustion chamber means comprises an enclosure of refractory material with divider means forming a primary combustion section and an afterburner section within said enclosure, and a combustion grate mounted in the primary combustion section for receiving the fragments of wood type fuel and for supporting the combusting fuel, said enclosure formed with an opening at the top over the combustion grate for gravity delivery of fuel onto the grate, said enclosure formed with combustion air inlet means at a level below said grate so that combustion air passes through said combustion grate means from below, said primary combustion section in which the combustion grate means is mounted constructed and arranged with horizontal cross sectional area substantially the same as said grate means whereby substantially all the combustion air passes through said grate means, said enclosure formed with draft outlet means spaced from the grate in the afterburner section for venting the products of combustion.

4. A new and improved retrofitting furnace system as set forth in claim 3 wherein said combustion grate is sized for fuel combustion at a rate to produce substantially the heat equivalence of the oil burner to be retrofitted by said new furnace system based upon the wood fuel combustion heat production of approximately 2000 BTU's per square inch of grate area.

5. A new and improved retrofitting furnace system as set forth in claim 4 wherein the ratio of solid to open portions of said combustion grate means is adapted to pass combustion air at an air flow rate substantially in the range of 10 to 40 cubic feet per minute under pressure differential of natural or induced draft effected by the equivalent of approximately 18 feet of chimney.

6. A new and improved retrofitting furnace system as set forth in claim 4 wherein said combustion grate is formed with a surface area in the range of approximately 30 to 60 square inches, and wherein the cross sectional area of the primary combustion section is substantially the same so that substantially all of the combustion air passes through the combustion grate means.

7. A new and improved retrofitting furnace system as set forth in claim 1, wherein said wood type fuel feeding means is constructed and arranged to trickle feed wood fuel fragments at a rate substantially in the range of approximately 8 to 20 lbs. per minute.

8. A new and improved retrofitting furnace system as set forth in claim 1 wherein said flame tube adapter means is formed with a cross sectional area sufficient for delivering the combustion exhaust heat at a rate substantially at the heat equivalence of the oil burner retrofitted by said new furnace system based upon the heat delivery of approximately 100,000 BTU capacity out of said wood fuel combustion chamber means per 12 square inches cross sectional area.

9. A new and improved retrofitting furnace system as set forth in claim 8 wherein said flame tube adapter means is formed with a selected length to afford substantially complete combustion of the exhaust gases from wood type fuel combustion while maintaining sufficient temperature to radiate heat into the oil combustion chamber and heat exchanger of a retrofitted oil furnace.

10. A new and improved retrofitting furnace system as set forth in claim 9 wherein said flame tube adapter means is selected to have a length substantially in the range of 12" to 15".

11. A new and improved system as set forth in claim 9 or claim 10 wherein said flame tube means is adapted for extension of the greater portion of its length into the oil combustion chamber of an oil furnace retrofitted by said new furnace system.

12. A new and improved retrofitting furnace system as set forth in claim 1 wherein said wood type fuel combustion chamber is formed with a combustion air inlet further comprising blower means coupled at the combustion air inlet of the wood type fuel combustion chamber for forcing excess combustion air through said combustion chamber.

13. A new and improved retrofitting furnace system as set forth in claim 1 wherein said wood type fuel feeding means comprises wood fuel fragment storage bin means, first means for trickle feeding wood fuel fragments from the storage bin means, second wood type fuel trickle feeding means having an inlet end spaced from the first trickle feeding means to form a first break in the continuity of the wood fuel fragments fed to the wood fuel combustion chamber means, said inlet end of the second trickle feeding means positioned to receive wood fuel fragments across the break from the first trickle feeding means, said second trickle feeding means formed with an outlet end positioned over the wood type fuel combustion chamber means to form a second break in the continuity of the wood fuel fragments, said outlet end of the second trickle feeding means positioned for trickle feeding wood type fuel fragments into the wood type fuel combustion chamber across said second break, thereby affording the safety measure of two breaks in the fuel feeding line between the fuel combustion chamber means and the fuel storage bin means.

14. A retrofitting furnace system as set forth in claim 13 wherein said wood fuel fragment storage bin means is comprised of a base, end walls and side walls, and wherein the side walls are constructed to slope toward the base at an angle of at least substantially 60°.

15. A retrofitting furnace system as set forth in claim 14 wherein said first wood type fuel feeding means comprises first auger means and first drive means for driving said auger means and wherein said sloping side walls converge toward said first auger means.

16. A retrofitting furnace system as set forth in claim 13 wherein said second wood type fuel fragment trickle feeding means comprises second auger means within concentric housing means, said second auger means oriented with a sloping attitude from a low end at the bin storage means to a high end over the wood type fuel combustion chamber means, and second drive means for driving said second auger means.

17. A retrofitting furnace system as set forth in claim 16 wherein the second wood type fuel feeding means further comprises pressure limit switch means mounted at the high end of the second trickle feeding auger means said pressure limit switch means responsive to jamming of the wood fuel in said second auger means and connected to shut of the drive means for the second auger means in the event of a jam in the wood fuel line.

18. A retrofitting furnace system as set forth in claim 16 wherein the second wood type fuel feeding means further comprises sprinkler head means mounted at the high end of the second trickle feeding auger means responsive to a high limit temperature for spraying water into the wood type fuel combustion chamber and fuel feeding means.

19. A retrofitting furnace system as set forth in claim 16 wherein the diameter of the concentric auger housing is approximately two inches greater than the diameter of the second auger means.

20. A retrofitting furnace system as set forth in claim 1 wherein said control means comprises a conventional oil furnace controller switch of the kind having a motor contact and an ignition contact, said oil controller switch responsive to a thermostat or other thermal switch for opening and closing said contacts, and wherein the wood type fuel feeding means draft establishing means are connected to the motor contact, and the ignition contact is connected for coupling to both an oil burner motor and ignition received in the wood fuel combustion chamber for igniting the wood type fuel.

21. A retrofitting furnace system as set forth in claim 20 further comprising delay means connected in the ignition contact line of said controller switch to delay turn on of an oil burner gun motor and igniter received in the wood type fuel combustion chamber until a draft is established through said wood type fuel combustion chamber.

22. A retrofitting furnace system as set forth in claim 1 wherein said means for establishing a draft through the retrofitted furnace system comprises first blower means coupled to the wood fuel combustion chamber for forcing air into said combustion chamber and second blower means mounted in the flue outlet of the oil furnace to be retrofitted for inducing a draft through the retrofitted furnace system.

23. A retrofitting furnace system as set forth in claim 1 wherein said means for establishing a draft through the retrofitted furnace system comprises blower means to be mounted in the flue outlet of the oil furnace to be retrofitted for inducing a draft through the retrofitted furnace system and further comprising stack switch means mounted for sensing flue gas temperature and connected for cutting off the oil burner gun and motor to be received at the wood fuel combustion chamber means.

24. A new and improved furnace system for retrofitting a conventional domestic oil furnace to provide for automatic, continuous, and efficient burning of chipped, hogged, pelletized or other fragmented wood type fuel, said conventional oil fired furnace of the kind having oil fuel combustion chamber means and heat exchange means, said oil furnace having an oil burner gun inlet to the oil combustion chamber with the oil burner gun removed, said new furnace system comprising:

wood fuel combustion chamber means formed by an enclosure of refractory material for combustion of the wood type fuel at elevated temperatures to substantially complete combustion, said enclosure formed with a primary combustion region and an afterburner region, a combustion grate positioned in the combustion region for receiving the fragments of wood type fuel and for supporting the combusting fuel, said enclosure formed with an opening at the top over the combustion grate for gravity delivery of fuel onto said grate, said enclosure formed with combustion air draft inlet means in the primary combustion region in the vicinity of the grate for introducing combustion air, and draft outlet means spaced from the grate in the afterburner region for venting the products of combustion;

flame tube means for coupling the wood fuel combustion chamber outlet with the oil combustion chamber inlet of a conventional oil fired furnace, said flame tube adapted for extending into the oil combustion chamber of a conventional oil furnace with the oil burner gun removed, said flame tube means formed with selected length to afford substantially complete combustion of the exhaust gases while maintaining sufficient temperature to radiate heat into the oil combustion chamber and heat exchanger;

wood type fuel fragment feeding means comprising conveyor means for trickle feeding wood fuel at selected uniform rates to a position over the wood fuel combustion chamber and the opening at the top of the chamber;

substantially vertical passageway means for gravity feed of the wood fuel type fragments from the conveyor means through the top of the wood fuel combustion chamber to the combustion grate, said passageway means affording a first break in the fuel line thereby to prevent propogation of combustion up the fuel line from the combustion chamber into the wood fuel feeding means;

blower means for inducing a forced draft through the wood fuel combustion chamber means, flame tube means, and conventional oil furnace combustion chamber and heat exchanger at least during start up of the furnace system;

said wood type fuel combustion chamber means adapted to receive oil burner gun motor and firing means at the inlet of said wood fuel combustion chamber for igniting wood fuel type fragments on the combustion grate and initiating sustained combustion of wood fuel received upon and supported by the combustion grate during start up of the furnace system;

and control means for controlling and sequencing said furnace system elements, said control means adapted to turn on the wood fuel trickle feeding means and induced draft blower means, and further fire the oil gun motor and firing means after the induced draft is established for igniting wood type fuel fragments received on the combustion grate, said control means adapted to turn off the oil gun motor and firing means once the wood type fuel is ignited and passing combustion heat through the system;

and safety switch control means for shutting down the system if the oil burner gun fails to operate or ignite the wood type fuel, if the induced draft fan fails to operate during start-up, or if combustion heat climbs up the fuel feed passageway.

25. A new and improved furnace system for retrofitting a conventional domestic oil furnace for combustion of fragmented wood type fuel upon removal of the oil gun motor and igniter means from the conventional oil furnace comprising:

wood fuel gun means comprising a refractory wood feed combustion chamber for efficient high temperature combustion of fragmented wood type fuels, fragmented wood type fuel feeding means for trickle feeding wood fuel fragments into the wood fuel combustion chamber at rates to produce upon combustion substantially the heat equivalence of the domestic oil burner gun motor and igniter means removed from a conventional oil furnace to be retrofitted, flame tube coupling means adapted for coupling combustion exhaust from the wood fuel combustion chamber into a conventional oil furnace to be retrofitted, said wood fuel combustion chamber adapted to receive the oil gun motor and igniter means removed from the conventional oil furnace for initiating combustion of wood type fuel in the wood fuel combustion chamber, means for forcing a draft through the wood fuel combustion chamber, and control means for controlling the fuel feeding means, forced draft means and the oil gun motor and igniter means of the conventional oil furnace to be retrofitted whereby said retrofitting furnace system affords automatic and continuous combustion and heat delivery from wood fuel fragments at rates comparable to the preretrofitted conventional oil burning furnace system.

26. A new and improved retrofitted furnace system, for combustion of wood type fuel fragments comprising:

conventional oil furnace means comprising oil combustion chamber means, heat exchanger means and oil gun motor and igniter means, said oil gun motor and igniter means removed from its mounting position at the oil combustion chamber;

wood fuel gun means comprising refractory wood fuel combustion chamber means for efficient and high temperature combustion of fragmented wood type fuels, fragmented wood type fuel feeding means for trickle feeding wood fuel fragments into the wood fuel combustion chamber at rates to produce upon combustion substantially the heat equivalence of said oil gun motor and igniter means, flame tube coupling means adapted for coupling combustion exhaust from the wood fuel combustion chamber into the oil combustion chamber of the retrofitted oil fired furnace, said wood fuel combustion chamber constructed and arranged for receiving the oil gun motor and igniter means for initiating combustion of wood type fuel in the wood fuel combustion chamber, and means for forcing a draft through the wood fuel combustion chamber;

said oil gun motor and igniter means mounted in the wood fuel combustion chamber for initiating combustion of wood type fuels in said combustion chamber;

and control means for controlling the wood type fuel feeding means, forced draft means, and oil gun motor and igniter means whereby said retrofitted furnace system affords automatic and continuous combustion and heat delivery from wood fuel fragments at rates comparable to the pre-retrofitted conventional oil furnace.

27. A new and improved residential scale furnace system for providing automatic, continuous, and efficient burning of chipped, hogged, pelletized or other fragmented wood type fuel, said furnace system comprising:

heat exchange plenum means having an inlet for receiving hot combustion gases and a chimney flue outlet, said heat exchange plenum adapted for transferring heat of combustion gases to a heat transfer medium;

wood fuel combustion chamber means formed by an enclosure of refractory material for combustion of the wood type fuel at elevated temperatures to substantially complete combustion, said enclosure formed with a primary combustion region and an afterburner region, a combustion grate positioned in the combustion region for receiving the fragments of wood type fuel and for supporting the combusting fuel, said enclosure formed with an opening at the top over the combustion grate for gravity delivery of fuel onto said grate, said enclosure formed with combustion air draft inlet means in the primary combustion region in the vicinity of the grate for introducing combustion air, and draft outlet means spaced from the grate in the afterburner region for venting the products of combustion;

flame tube couplnng means for coupling the wood fuel combustion chamber outlet with the heat exchange plenum means inlet, said flame tube adapted for extending into the heat exchange plenum means, said flame tube coupling means formed with selected length sufficient to afford substantially complete combustion of the exhaust gases while maintaining sufficient temperature to radiate heat into the heat exchange plenum;

wood type fuel fragment feeding means comprising conveyor means for trickle feeding wood fuel at selected uniform rates to a position over the wood fuel combustion chamber and the opening at the top of the chamber;

substantially vertical passageway means for gravity feed of the wood fuel type fragments from the conveyor means through the top of the wood fuel combustion chamber to the combustion grate, said passageway means affording at least a first break in the fuel line thereby to prevent propogation of combustion up the fuel line from the combustion chamber into the wood fuel feeding means;

blower means for inducing a forced draft through the wood fuel combustion chamber means, flame tube means, and heat exchange plenum means at least during start up of the furnace system;

said wood type fuel combustion chamber means adapted to receive oil burner gun motor and firing means at the inlet of said wood fuel combustion chamber for igniting wood fuel type fragments on the combustion grate and initiating sustained combustion of wood fuel received upon and supported by the combustion grate during start up of the furnace system;

control means for controlling and sequencing said furnace system elements, said control means adapted to turn on the wood fuel trickle feeding means and induced draft blower means, and further fire the oil gun motor and firing means after the induced draft is established for igniting wood type fuel fragments received on the combustion grate, said control means adapted to turn off the oil gun motor and firing means once the wood type fuel is ignited and delivery combustion heat through the system;

and safety switch control means for shutting down the system if the oil burner gun fails to operate or ignite the wood type fuel, if the induced draft fan fails to operate during start-up, or if excessive combustion heat climbs up the fuel feed passageway.

* * * * *